US008371365B2

(12) United States Patent
Kesseli et al.

(10) Patent No.: US 8,371,365 B2
(45) Date of Patent: Feb. 12, 2013

(54) HEAT EXCHANGE DEVICE AND METHOD FOR MANUFACTURE

(75) Inventors: James B. Kesseli, Greenland, NH (US); Antoine H. Corbeil, Gatineau (CA)

(73) Assignee: Brayton Energy, LLC, Hampton, NH (US)

( * ) Notice: Subject to any disclaimer, the term of this patent is extended or adjusted under 35 U.S.C. 154(b) by 1189 days.

(21) Appl. No.: 12/115,069

(22) Filed: May 5, 2008

(65) Prior Publication Data

US 2009/0211740 A1 Aug. 27, 2009

Related U.S. Application Data

(60) Provisional application No. 60/927,532, filed on May 3, 2007.

(51) Int. Cl.
*F28F 3/08* (2006.01)
*F28D 1/02* (2006.01)

(52) U.S. Cl. ..... 165/167; 165/153

(58) Field of Classification Search ..... 165/165, 165/166, 167, 170, 175, 176, 153
See application file for complete search history.

(56) References Cited

U.S. PATENT DOCUMENTS

| | | | | |
|---|---|---|---|---|
| 2,368,732 | A * | 2/1945 | Wallgren | 165/167 |
| 2,648,527 | A * | 8/1953 | Carnahan | 165/167 |
| 3,444,926 | A * | 5/1969 | Stalberg | 165/166 |
| 3,460,611 | A | 8/1969 | Folsom et al. | |
| 4,073,340 | A | 2/1978 | Parker | |
| 4,229,868 | A | 10/1980 | Kretzinger | |
| 4,258,784 | A | 3/1981 | Perry et al. | |
| 4,291,754 | A * | 9/1981 | Morse et al. | 165/165 |
| 4,815,534 | A | 3/1989 | Fuerschbach | |
| 5,184,673 | A * | 2/1993 | Hedman et al. | 165/153 |
| 5,400,854 | A * | 3/1995 | Iio et al. | 165/157 |
| 5,983,992 | A * | 11/1999 | Child et al. | 165/81 |
| 6,170,567 | B1 * | 1/2001 | Nakada et al. | 165/153 |
| 6,196,304 | B1 * | 3/2001 | Schwarz | 165/140 |
| 6,260,612 | B1 * | 7/2001 | Nakamura et al. | 165/82 |
| 6,305,079 | B1 | 10/2001 | Child et al. | |
| 2001/0025705 | A1 | 10/2001 | Nash et al. | |
| 2002/0026999 | A1 | 3/2002 | Wu et al. | |
| 2003/0024696 | A1 * | 2/2003 | Haplau-Colan et al. | 165/153 |
| 2005/0121173 | A1 * | 6/2005 | Inagaki et al. | 165/80.3 |
| 2009/0211739 | A1 | 8/2009 | Nash et al. | |

FOREIGN PATENT DOCUMENTS

| | | | |
|---|---|---|---|
| FR | 1494167 | A | 9/1967 |
| GB | 1062241 | A | 3/1967 |
| GB | 1197449 | A | 7/1970 |
| GB | 1304692 | A | 1/1973 |

OTHER PUBLICATIONS

PCT International Search Report and Written Opinion received in PCT/US2009/042835, dated Jul. 7, 2009.
PCT International Search Report and Written Opinion received in PCT/US2009/042849, dated Jul. 2, 2009.

* cited by examiner

*Primary Examiner* — Tho V Duong
(74) *Attorney, Agent, or Firm* — McLane, Graf, Raulerson & Middleton, Professional Association

(57) ABSTRACT

A heat exchange device of a type for affecting an exchange of heat between a first and second fluid is characterized by a plurality of heat exchange cells in a stacked arrangement wherein each cell includes inlet and outlet manifold rings which define inlet and outlet manifolds, respectively. Adjacent heat exchange cells are bonded to one another via metallurgical bonds between the contacting surfaces of the manifold rings. In a further aspect, a method for the manufacture of a heat exchange device is provided.

26 Claims, 16 Drawing Sheets

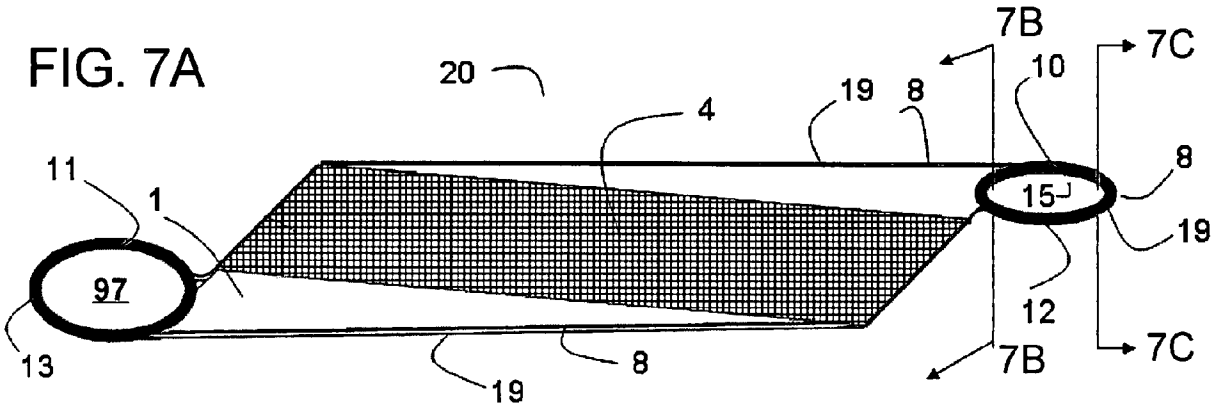
FIG. 7A
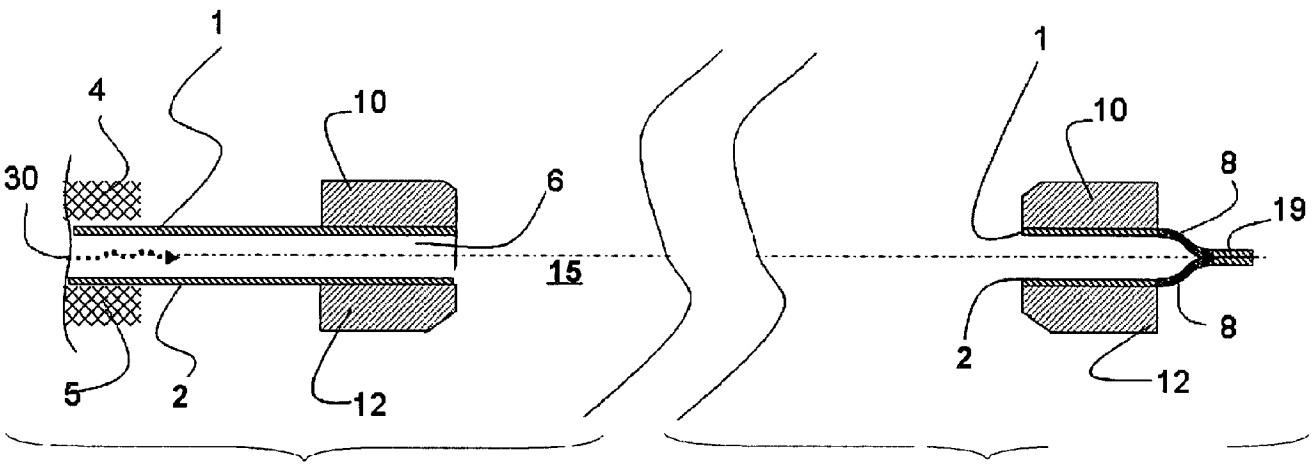
FIG. 7B
FIG. 7C

External surface exposed for view

Internal surface exposed for view

HEAT EXCHANGE DEVICE AND METHOD FOR MANUFACTURE

CROSS-REFERENCE TO RELATED APPLICATION

This application claims priority under 35 U.S.C. §119(e) to U.S. provisional application Ser. No. 60/927,532 filed May 3, 2007. The aforementioned provisional application is incorporated herein by reference in its entirety.

BACKGROUND

This disclosure relates generally to heat exchangers with features directed to various innovations including ones relating to the gas turbine recuperators.

The recuperation of the gas turbine engine has been proven to increase thermal efficiency. However, the technical challenges associated with surviving the severe environment of a gas turbine exhaust while meeting the equally severe cost challenges has limited the number of viable products. A gas turbine recuperator is typically exposed to a thermal gradient of up to 600 degrees C., pressures of 3 to 16 bar, and may operate at a gas temperature of over 700 degrees C. Moreover, developers of advanced recuperated Brayton (gas turbine) systems are considering applications with pressures of up to 80 bar and temperatures ranging to 1000 degrees C.

The successful design must tolerate severe thermal gradients, and repeated thermal cycling, by allowing unrestricted thermal strain. The structural requirements to manage very high pressures tend to work against the normal design preferences for structural flexibility, which is important to tolerating large and rapid thermal transients.

Child, Kesseli, and Nash (U.S. Pat. No. 5,983,992) describe a flexible heat exchanger design as shown in FIGS. 1A-1C. This design is composed of stamped parting sheets A, B, each formed with "substantially S-shaped" raised flanges C, D. These stamped hoops form an integral manifold in the plate. When welded cell to cell, the stack of manifolds becomes a flexible bellows-like structure. This feature represents the principal novelty of this prior art design over heat exchangers embodying a more rigid structure. While the flexibility of the manifold represents an advantage in environments of high thermal-induced strain, the thickness of the sheet and the manifold geometry limits its capacity for pressure. The inventors state that the light gauge sheet metal construction is critical to the performance and integrity of this design and superior to other designs employing edge bar or closure bar construction.

As exemplified by U.S. Pat. No. 4,073,340 to Garrett, other traditional manufacturers have produced heat exchangers formed of individual cells, brazed together employing stamped edge conditions and integral cut-out manifolds cut-out from the parting plate, principally similar to Child et al. (U.S. Pat. No. 5,983,992). FIGS. 2A and 2B illustrate the heat exchange apparatus of Garrett and shows stamped formed edge sheets E and manifold cutouts F and G. The complete heat exchanger core of this configuration is formed by coating the various elements with braze alloy, stacking the plates and secondary fin surfaces, and brazing the complete assembly in a furnace. Due to the sturdy edge bars, this design construction is likely to tolerate considerably higher pressures than the apparatus of Child et al. (U.S. Pat. No. 5,983,992). However, due to the monolithic structure formed as all contacting plate and fin surfaces are brazed, the rigid heat exchanger construction is prone to stress cracking caused by repeated thermal cycling.

British Patent No. 1,197,449 to Chausson shows a formed header like Child et al. (U.S. Pat. No. 5,983,992) and Garrett (U.S. Pat. No. 4,073,340) and the raised sheet metal manifold integral with the parting plates. Referring to FIG. 3, there appears the heat exchanger of GB1,197,449, which has a formed dish-shaped edge K, a high-density fin M between the parting plates, communicating with the formed manifold cut-out L, configured to carry the first fluid. The second fluid, flowing on the outer surface of the parting plates passes through high-density fin matrix elements N and O, configured to carry the second fluid. The high-density fin matrix elements N, O are brazed to the parting plates, but not to one another, in a manner similar to Child et al. (U.S. Pat. No. 5,983,992). In addition, as with the device of Child et al., the construction is of light gauge sheet metal and best suited for low to moderate pressures.

Lowery (British Patent No. 1,304,692) discloses a cellular heat exchanger concept as shown in FIG. 4. Like Child et al. and GB1,197,449, this design uses a unit cell with light gauge external fin elements R and S bonded to the outside of an envelope forming a flow path for a first fluid, with internal passages inside the envelope forming passages for a second fluid. Also, as with the devices of Child et al. and GB1,197,449, the fin elements R and S of neighboring cells bear upon one another at crests T. A unique feature of this design relates to the heavy "pressings" forming the passages of the second fluid. These heavy pressings located in a hot gas stream tend lag in thermal response and consequently are prone to buckle when exposed to high temperature and steep thermal gradients. This design is most suitable for lower temperature air-water "radiator" applications.

U.S. Pat. No. 3,460,611 to Folsom et al. describes a plate-fin heat exchanger incorporating formed parting plates and strip fin. Quoting from this specification, "These parts are bonded or soldered together to make an integral unit or module and before that unit is incorporated in a stack or modules it conveniently may be tested and proven without leaks or cause to attain that condition." See Folsom et al. at column 2, lines 51-55. See also claims 1 through 6 of U.S. Pat. No. 6,305,079 to Child et al. The heat exchange cell of Folsom et al., like that of Child et al, has formed lands around the perimeter. The apparatuses of Folsom et al. and Child et al. both incorporate formed lands around the header, thereby creating a cell not suitable for high internal pressure. Also, Folsom's formed semi-circular manifold requires an additional welding operation to attach the cell to a pipe or collector.

Based upon the foregoing limitations known to exist in plate-fin heat exchangers, it would be beneficial to provide a heat exchanger having a rigid manifold section capable of operation at elevated pressure, connecting to a light gauge, flexible sheet metal structure imposing limited mechanical constraints on and between neighboring cells.

SUMMARY

In one aspect, the present disclosure relates to a heat exchange device for transferring heat between a first fluid and a second fluid and comprising a plurality of heat exchange cells in a stacked arrangement and defining an inlet manifold and an outlet manifold. Each of the heat exchange cells comprises an upper cell plate having an exterior facing surface and an interior facing surface opposite the exterior facing surface. The upper cell plate has an inlet aperture, an outlet aperture, a central upper cell plate portion extending between the inlet aperture and the outlet aperture, and an upper peripheral edge bounding the inlet aperture, outlet aperture, and the central upper cell plate portion. A lower cell plate has an exterior facing surface and an interior facing surface opposite the exterior facing surface. The lower cell plate has an inlet aperture, an outlet aperture, a central lower cell plate portion, and a lower peripheral edge bounding the inlet aperture, outlet aperture, and the central lower cell plate portion. The lower cell plate is juxtaposed with the upper cell plate so that the inlet aperture of the lower cell plate is aligned with the inlet aperture of the upper cell plate, the outlet aperture of the lower cell plate is aligned with the outlet aperture of the upper cell plate, and the central lower cell plate portion is aligned with the central upper cell plate portion. The upper peripheral edge is joined to the lower peripheral edge to define a cell peripheral edge. The interior facing surface of the upper cell plate faces and is spaced apart from the interior facing surface of the lower cell plate to define an interior volume therebetween. The interior volume has a cell inlet and a cell outlet and defining a fluid passageway for the second fluid between the cell inlet and the cell outlet, wherein the cell inlet is adjacent the inlet aperture of the upper cell plate and the inlet aperture of the lower cell plate, and the cell outlet is adjacent the outlet aperture of the upper cell plate and the outlet aperture of the lower cell plate. A first heat transfer matrix is positioned within the interior volume, a second heat transfer matrix is attached to the exterior surface of the upper cell plate, and a third heat transfer matrix is attached to the exterior surface of the lower cell plate. An upper inlet manifold ring is attached to the exterior surface of the upper plate and circumscribes the inlet aperture of the upper cell plate. An upper outlet manifold ring is attached to the exterior surface of the upper plate and circumscribes the outlet aperture of the upper cell plate. A lower inlet manifold ring is attached to the exterior surface of the lower plate and circumscribes the inlet aperture of the lower cell plate. A lower outlet manifold ring is attached to the exterior surface of the lower plate and circumscribes the outlet aperture of the lower cell plate.

In a second aspect, the present disclosure relates to a method of manufacturing a heat exchange device of a type for transferring heat between a first fluid and a second fluid, the method including assembling a plurality of heat exchange cells. Each heat exchange cell comprises an upper cell plate having an exterior facing surface and an interior facing surface opposite the exterior facing surface. The upper cell plate has an inlet aperture, an outlet aperture, a central upper cell plate portion extending between the inlet aperture and the outlet aperture, and an upper peripheral edge bounding the inlet aperture, outlet aperture, and the central upper cell plate portion. A lower cell plate has an exterior facing surface and an interior facing surface opposite the exterior facing surface. The lower cell plate has an inlet aperture, an outlet aperture, a central lower cell plate portion, and a lower peripheral edge bounding the inlet aperture, outlet aperture, and the central lower cell plate portion. The lower cell plate is juxtaposed with the upper cell plate so that the inlet aperture of the lower cell plate is aligned with the inlet aperture of the upper cell plate, the outlet aperture of the lower cell plate is aligned with the outlet aperture of the upper cell plate, and the central lower cell plate portion is aligned with the central upper cell plate portion. The upper peripheral edge is joined to the lower peripheral edge to define a cell peripheral edge. The interior facing surface of the upper cell plate faces and is spaced apart from the interior facing surface of the lower cell plate to define an interior volume therebetween. The interior volume has a cell inlet and a cell outlet and defining a fluid passageway for the second fluid between the cell inlet and the cell outlet, wherein the cell inlet is adjacent the inlet aperture of the upper cell plate and the inlet aperture of the lower cell plate, and the cell outlet is adjacent the outlet aperture of the upper cell plate and the outlet aperture of the lower cell plate. A first heat transfer matrix is positioned within the interior volume, a second heat transfer matrix is attached to the exterior surface of the upper cell plate, and a third heat transfer matrix is attached to the exterior surface of the lower cell plate. An upper inlet manifold ring is attached to the exterior surface of the upper plate and circumscribes the inlet aperture of the upper cell plate. An upper outlet manifold ring is attached to the exterior surface of the upper plate and circumscribes the outlet aperture of the upper cell plate. A lower inlet manifold ring is attached to the exterior surface of the lower plate and circumscribes the inlet aperture of the lower cell plate. A lower outlet manifold ring is attached to the exterior surface of the lower plate and circumscribes the outlet aperture of the lower cell plate. The plurality of heat exchange cells are stacked such that a contacting surface of the lower inlet manifold ring of one of the plurality of the heat exchange cells contacts a contacting surface of the upper inlet manifold ring of an adjacent one of the plurality of heat exchange cells and a contacting surface of the lower outlet manifold ring of the one of the plurality of the heat exchange cells contacts a contacting surface of the upper outlet manifold ring of the adjacent one of the plurality of heat exchange cells. The plurality of heat exchange cells are metallurgically joined at the contacting surfaces of the upper and lower inlet manifold rings and the contacting surfaces of the upper and lower outlet manifold rings.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

FIG. 7A illustrates the assembled elemental heat exchanger cell shown in FIG. 5.

FIG. 7B is a side cross-sectional view taken along the lines 7B-7B in FIG. 7A.

FIG. 7C is a side cross-sectional view taken along the lines 7C-7C in FIG. 7A.

DETAILED DESCRIPTION OF THE PREFERRED EMBODIMENTS

Figure 5:
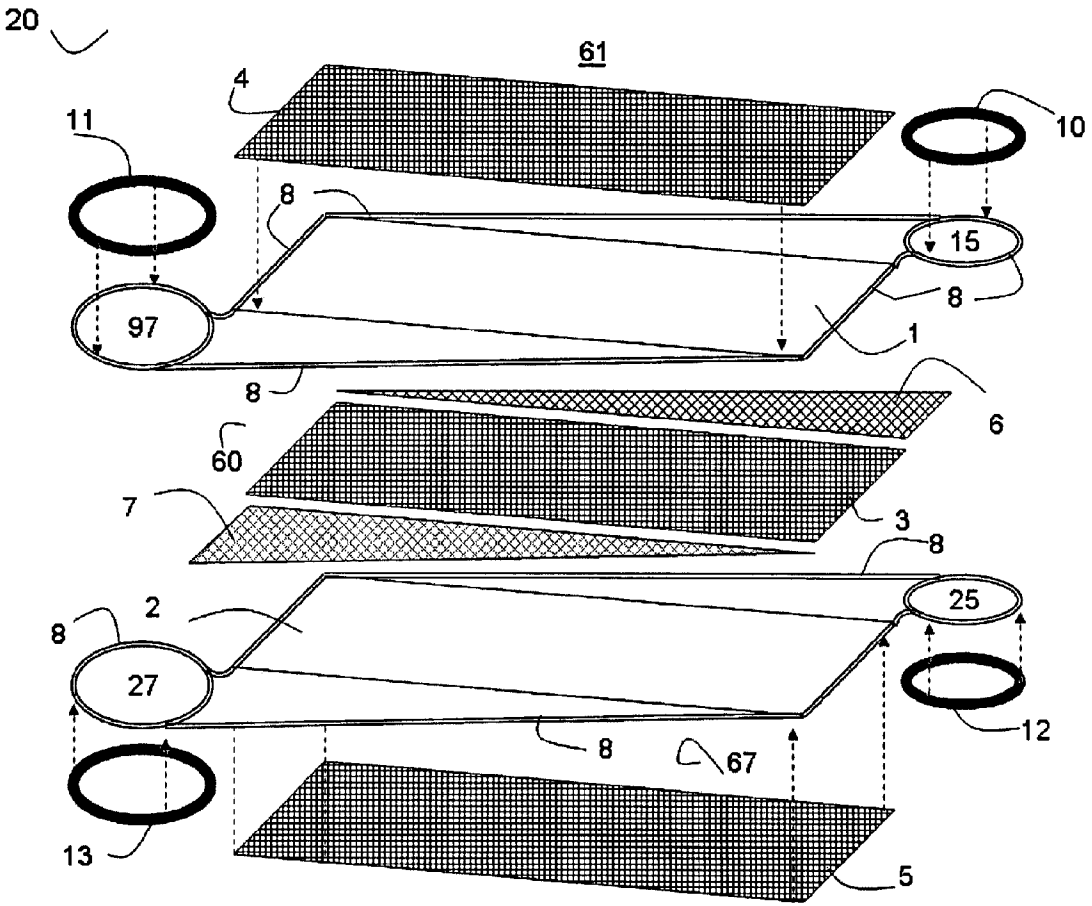
FIG. 5 is an exploded view of an elemental heat exchanger in accordance with an exemplary embodiment of the present invention.

FIG. 5 shows an exploded view of an elemental counter-flow heat exchange element 20 with cross-flow header sections. The cell 20 includes upper and lower sheets 1 and 2, respectively, which are a mirror image of one another and are assembled to form an envelope with interior 60 and exterior 61 volumes. A high surface area matrix 3 is located between the plates 1 and 2 in the interior volume 60. Another high surface area matrix element 4 is affixed to the exterior surface of plate 1 in the volume 61, while yet another high surface area matrix 5 is affixed to the exterior surface of plate 2 in an exterior volume 67. The high surface area matrix elements 3, 4, 5 may be, for example, a folded or corrugated sheet metal material, dimpled sheet, sintered porous media, expanded metal foam, a screen pack, or any other type of secondary surface fin material common to the industry. Some favorable properties of the matrix elements 3, 4, 5 include a large surface to volume ratio, high thermal conductivity, and low manufacturing cost.

The parting plates 1 and 2 may be cut from sheet stock with a profile similar to that shown in FIG. 5. The features on the parting plate 1 are a mirror image of those of parting plate 2. The parting plates 1, 2 depicted in FIG. 5 are designed to accommodate the generally rectangular counter-flow matrix 3 and two cross-flow header matrix elements 6, 7 within the interior volume 61 defined between the two juxtaposed parting plates 1, 2. The cross-flow area occupied by the header matrix elements 6 and 7 may have a tapering triangular shape as shown in FIG. 5, and functions to distribute the fluid uniformly across the leading edge of the counter-flow matrix element 3.

Figure 1B:
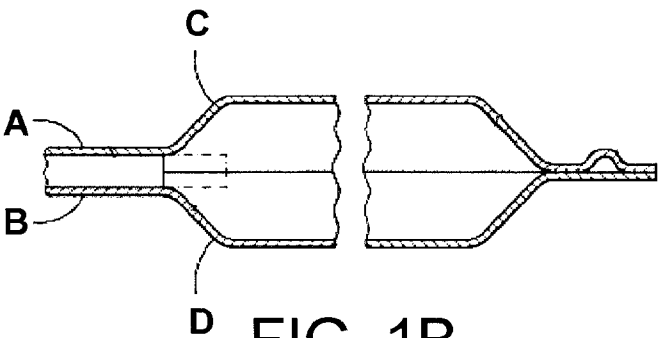
FIG. 1B (PRIOR ART)
FIGS. 1A-1C illustrate a prior art heat exchanger, showing an elemental heat exchanger disclosed in U.S. Pat. No. 5,983,992 to Child, Kesseli, and Nash.
Figure 1C:
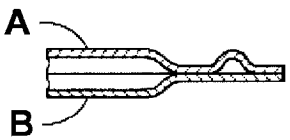
FIG. 1C (PRIOR ART)
Figure 1A:
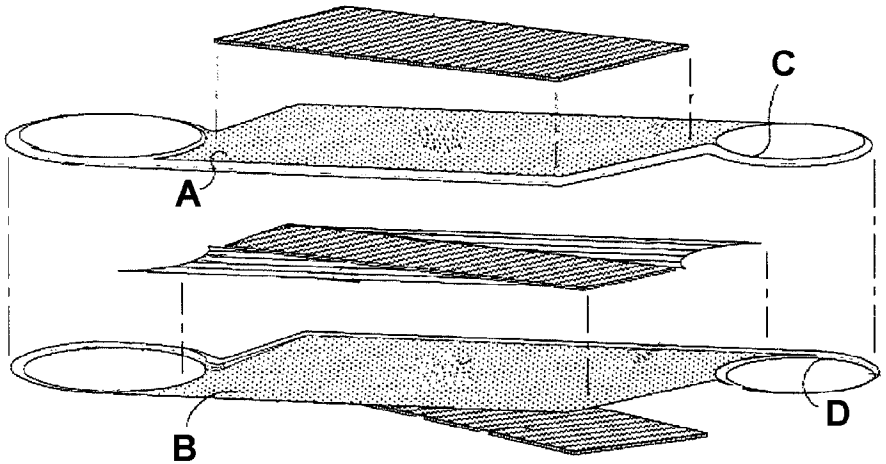
FIG. 1A (PRIOR ART)
Figure 2A:
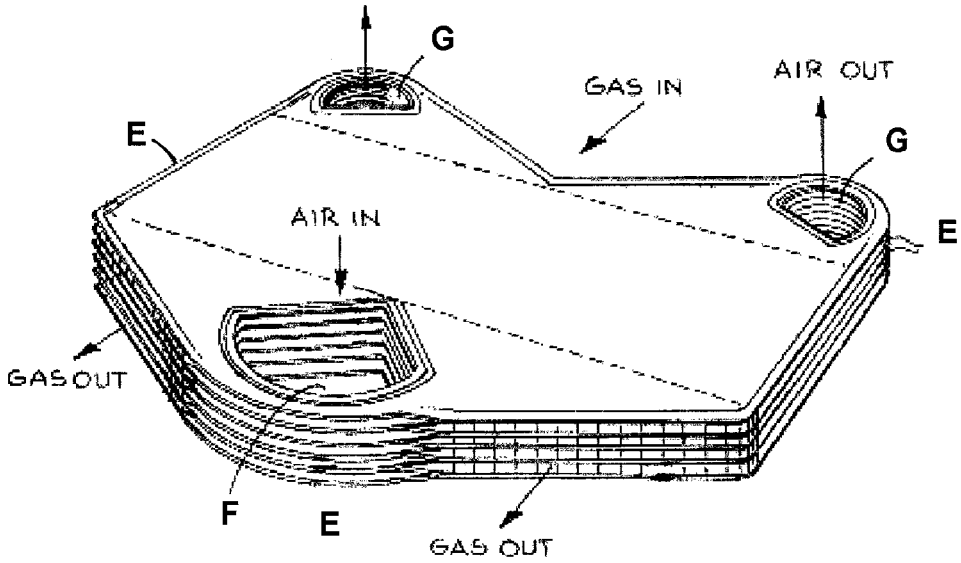
FIG. 2A (PRIOR ART)
FIGS. 2A and 2B illustrate another prior art heat exchanger as shown in U.S. Pat. No. 4,073,340 to Garrett.
Figure 2B:
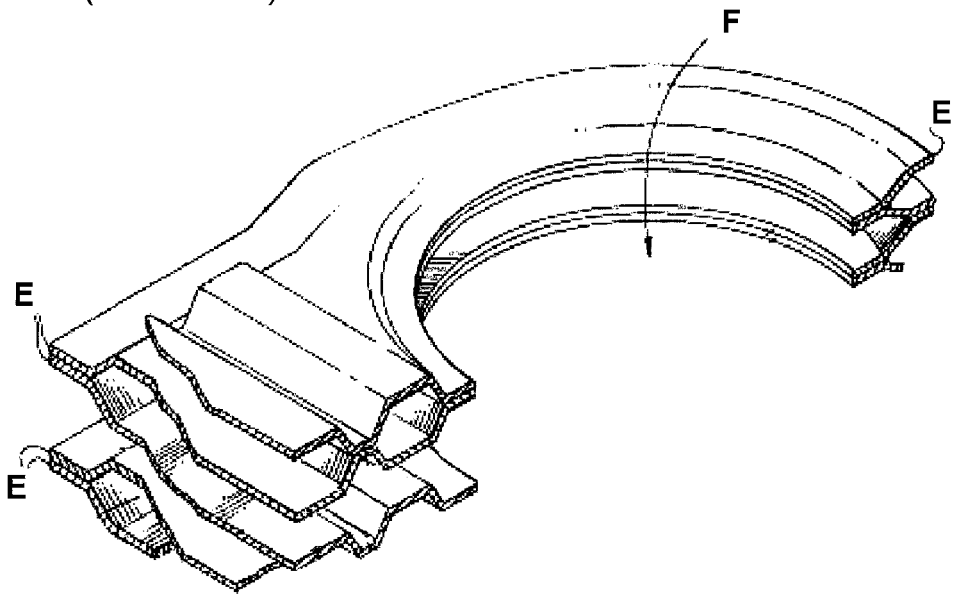
FIG. 2B (PRIOR ART)
Figure 3:
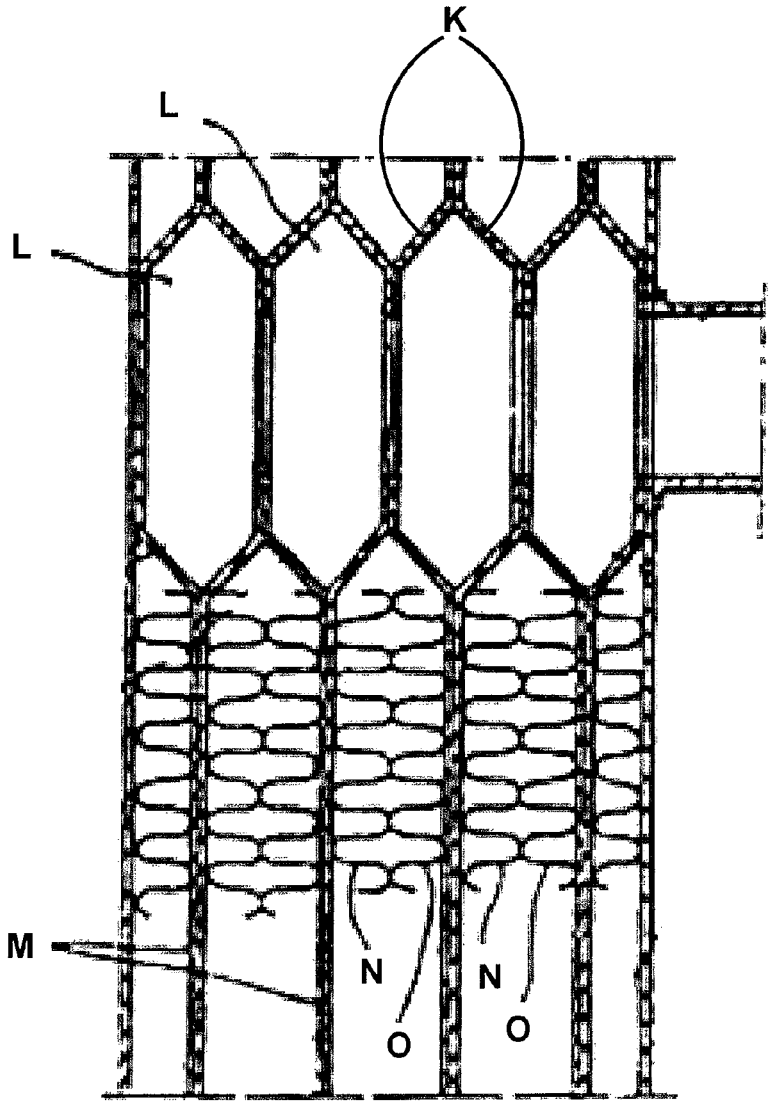
FIG. 3 (PRIOR ART)
FIG. 3 illustrates a heat exchanger design as shown in British Patent No. 1,197,449.
Figure 4:
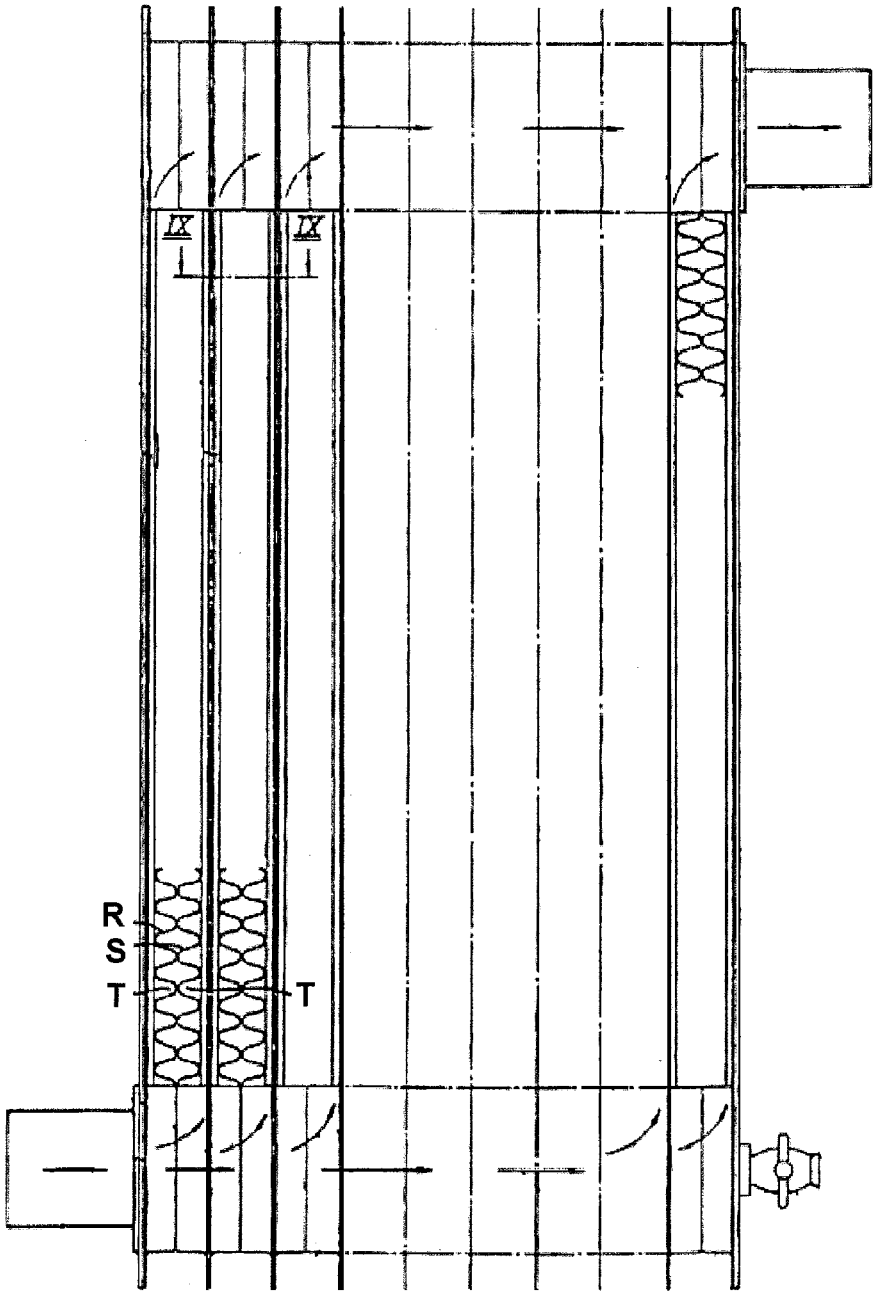
FIG. 4 (PRIOR ART)
FIG. 4 illustrates yet another heat exchanger of the prior art, as disclosed in British Patent No. 1,304,692.

Manifolds serve as a means for collecting the fluid flow from the headers. The manifolds for each cross-flow header are formed by cutting holes 15 and 97 in each parting plate 1 and cutout apertures 25 and 27 in each plate 2 intersecting the area occupied header matrix elements 6 and 7. A circular manifold ring 10 is affixed on the exterior facing surface of the flat sheet 1, in substantial alignment and circumscribing the diameter of cutout 15. Similarly, a manifold ring 11 is affixed to the exterior surface of the flat sheet 1 surrounding the cutout 97. Although the manifold rings and the corresponding cutout portions in the upper and lower cell plates are shown herein as being generally circular in cross-sectional shape, other manifold shapes are contemplates, such as inlet and outlet manifolds having a generally D-shaped cross section (see, e.g., FIG. 2A, reference character G), among others.

As plate 2 is a mirror image of plate 1, manifold rings 12 and 13 are affixed to the exterior facing surface of the flat plate 2, surrounding manifold cutouts 25 and 27, respectively. The manifold rings 10, 11, 12, 13 provide structural reinforcement of the manifold defined thereby and serve as a weldable flange when joining the elemental heat exchanger cell to like cells or termination flanges, e.g., when forming an assembled heat exchange unit comprising a stacked plurality of heat exchange cells 20. The thickness of the manifold rings is substantially equal to that or the counter-flow matrix element 4 or 5, also affixed to the exterior surface of the envelope formed by the respective parting plates 1 and 2.

Figure 6A:
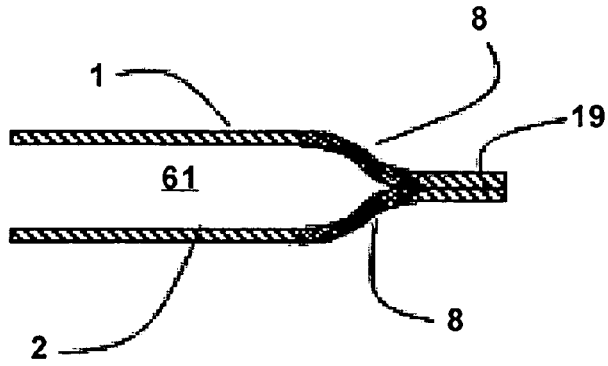
FIGS. 6A and 6B are enlarged, fragmentary, side cross-sectional views illustrates two exemplary options for edge conditions.
Figure 6B:
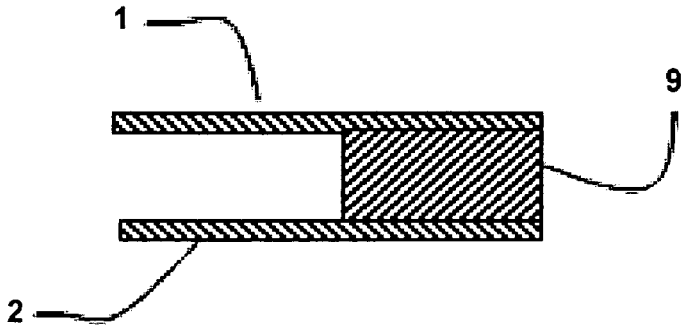

The perimeter of the parting plates 1 and 2 may be formed, for example, by either option illustrated in FIGS. 6A and 6B. FIG. 6A illustrates a dish-shaped edge 8, as is typical in the forming industry. The dish-shaped edge 8 forms a raised flange 19 around the complete perimeter of the sheet, concaved towards the interior volume 60 of the envelope. The elevation of the raised flange 19 relative to the lower plate 2 is sized to be nominally equal to one-half of the thickness of the internal matrix 3 element.

An alternative perimeter configuration is shown in FIG. 6B wherein a metallic ring 9 having a thickness matching that of the interior matrix 3 is positioned around the perimeter of the cell 20 to be secured via metallurgical bonding, e.g., via welding, brazing, diffusion bonding, etc., to the edges of the flat parting plates 1, 2. This relatively thick bar 9 or the dish-shaped edge 19 represent conventional but competing alternatives for sealing and spacing the parting plates 1, 2. When production quantities are small, the edge bar 9 method represents the cost-effective alternative, requiring minimal tooling. When production volumes justify greater tooling investment, the dish-shaped edge 8 may reduce product cost by reducing labor.

In alternative embodiments, the heat exchanger embodiments herein may be constructed from materials other than metals or metallic alloys. Such alternative materials include, for example, ceramic materials and high-temperature polymers. In these cases, the cell elements may be joined by sintering, cementing, adhesive bonding, or other surface-surface fusing or solid state joining processes.

FIG. 7A is an isometric view of the assembled heat exchange envelope of cell 20 formed by plates 1 and 2 with reinforcing rings 10 and 12. FIGS. 7B and 7C are cross-sectional views through proximal and distal portions, respectively, of the rings 10, 12. The inner diameter of the reinforcing rings 10 and 12 are in substantial alignment with the diameter cutouts 15 and 25. The manifold reinforcing ring 10 is affixed to the outer surface of the parting plate 1 while the reinforcing manifold ring 12 is affixed to the outer surface of parting plate 2. Similarly, the reinforcing rings 11, 13 are affixed to plates 1 and 2, respectively, surrounding respective manifold cutouts 97 and 27, with the ring 11, 13 inner diameters being in substantial alignment with the apertures 97 and 25. The thickness of the reinforcing rings 10, 11, 12, and 13 are equal to the height of the counter-flow matrix 4, 5.

In a preferred embodiment, to create the heat exchanger cell 20 embodiment as shown in FIGS. 7A-7C, the parting plates 1, 2 are coated with braze alloy at all of the contact points between the cell's components. The internal elements of the heat exchanger cell are assembled with the counter-flow matrix 3 and the cross-flow matrix headers 6 and 7 between the parting plates 1, 2 so that the circular headers 15, 25 are in close alignment. The adjacent counter-flow matrix elements 4 and 5 are positioned on the exterior surfaces of the respective plates 1, 2 in the respective adjacent exterior regions 61, 67 of the envelope 20. When the mirror image parting plates 1 and 2 are in substantial alignment, the dish-shaped flanges 19 of the plates contact one another, forming a continuous contact surface around the perimeter of the cell 20.

The heat exchange cell 20 may be formed by a typical oven-braze operation, joining the cell elements consisting of parting plates 1, 2, inner counter-flow matrix 3, header matrix elements 6 and 7, the edge bar 9 or flange 19, the external counter flow matrix segments 4, 5 and the circular reinforcing rings 10,11, 12, 13.

Figure 8A:
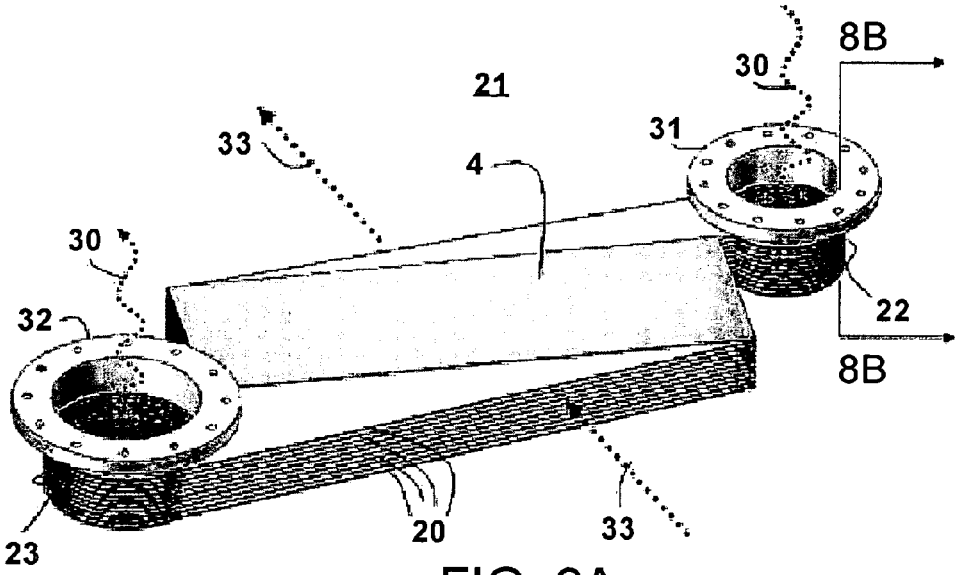
FIG. 8A illustrates the heat exchanger core, formed of multiple elemental cells.
Figure 8B:
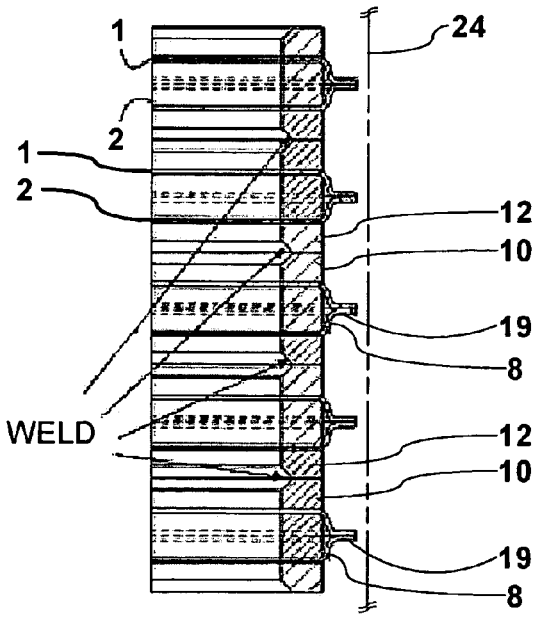
FIG. 8B is a side cross-sectional view taken along the lines 8B-8B in FIG. 8A.

Stacking a plurality of individual heat exchange cells 20 as shown in FIGS. 8A and 8B may form a heat exchanger of any reasonable size. Each cell 20 is positioned in substantial alignment with the other like cells, each contacting its neighbor at the external counter-flow matrix surfaces 4 and 5 and with reinforcing rings 10 and 11 of one cell 10 contacting reinforcing rings 12 and 13, respectively, the neighboring cell.

The final assembly of a heat exchanger core 21, comprising a plurality of cells 20 is produced by metallurgically bonding, e.g., welding, brazing, soldering, or diffusion bonding, the plurality of cells 20 at the surface of contact between contacting reinforcing rings 10 and 12 and between the surface of contact between contacting rings 11 and 13. The counter-flow matrix segments 4 contacting its neighbor 5 are not bonded, but may bear on one another. The conduit formed by the reinforcing rings 10 and 12, cutouts 15 and 25 in parting plates 1 and 2 serves as a manifold 22 for the fluid entering the heat exchanger core. Likewise, the conduit formed by the reinforcing rings 11 and 13, and cut-outs 97 and 27 in parting plates 1 and 2 serves as a manifold 23 for fluid exiting the heat exchanger core. Because the contact surface between the matrix element 4 and 5 of adjacent cells is not bonded, the cells 20 present little resistance to the independent thermal growth between the two manifold stacks 22 and 23. The assembled heat exchanger including the heat exchange core 21 further includes external ducting 24 (see FIG. 8B) surrounding the core for directing the flow of the low pressure heat exchange medium through the external heat exchange matrices 4, 5. The external ducting 24 receiving the heat exchange core 21 may be of any known or conventional type as would be understood by persons skilled in the art.

The heat exchanger 21 in FIGS. 8A and 8B functions as a first fluid 30 enters a flange 31, attached to the manifold stack 22. The fluid 30 enters the header matrix element 6 of each cell 20 that is in communication with the conduit formed by the manifold stack 22. The fluid 30 travels from the header matrix 6 to the counter-flow matrix 3 and then to the header matrix 7 and into the manifold stack 23. The first fluid 30 exits through a flange 32. The flanges 31 and 32, or alternatively "V"-band connections or other method of mechanical attachment are welded, brazed, soldered, diffusion bonded, or the like, to the top cell 20 to facilitate ducting the first fluid 30 in and out of the core 21. A second fluid 33 passes through the exterior, low-pressure matrices 4, 5 on the exterior surfaces of the plates 1, 2.

In operation, the first fluid 30 may be a low temperature, high-pressure fluid and the second fluid may be a high temperature, low-pressure fluid. By way of example, waste heat in a relatively low-pressure fluid 33 can be recovered via thermal transfer to a high-pressure fluid passing through the interior counter flow matrices 3 within the interior volumes 61 of the heat exchange cells 20. In a preferred embodiment, the first fluid 30 may be a working fluid such as compressed air for expansion through the turbine stage of a turbomachine, for example, to generate electrical and/or rotary shaft power and the second fluid 33 may be high-temperature, low-pressure turbine exhaust gas.

Figure 9:
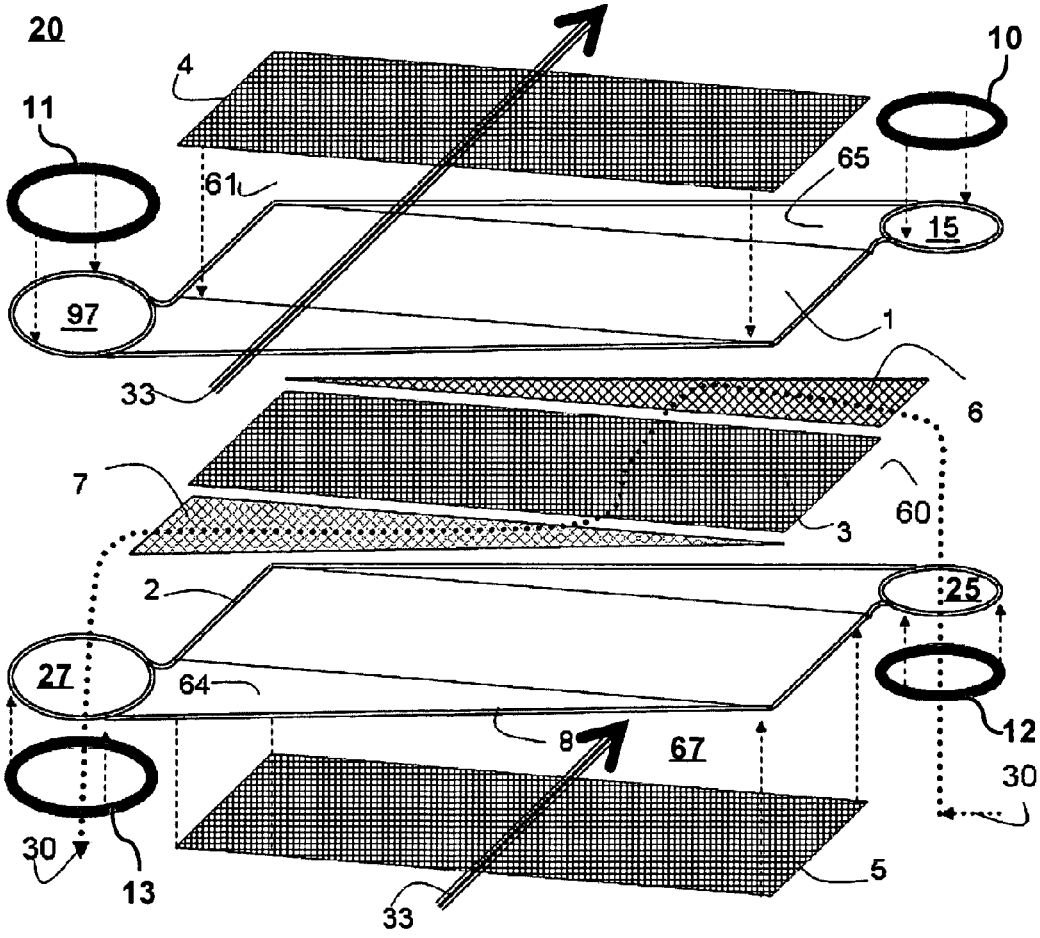
FIG. 9 illustrates the flow path of the first and second fluids through the elemental cell.

FIG. 9 illustrates the flow path of the first fluid 30 within the cell 20 and the flow path of the second fluid 33 between the cells 20. The fluid 30 enters the header matrix 6, flows through the matrix header 6, and turns into the counter-flow matrix 3 sandwiched between the parting plates 1 and 2. The fluid exiting the counter-flow matrix 3 collects in header matrix 7 and flows toward the exit manifold 23.

The second fluid 33 flows across the outer surface of the cross-flow header region 64 and enters the counter-flow matrix segments 4 and 5. The second fluid 33 exits the heat exchanger core 21, flowing over the outer cell surface of the cross-flow header region 65. The high surface area of the matrix elements 3, 4, and 5 and the small hydraulic diameters within such matrix segments enhance heat exchange between the first fluid 30 and the second fluid 33.

Figure 10:
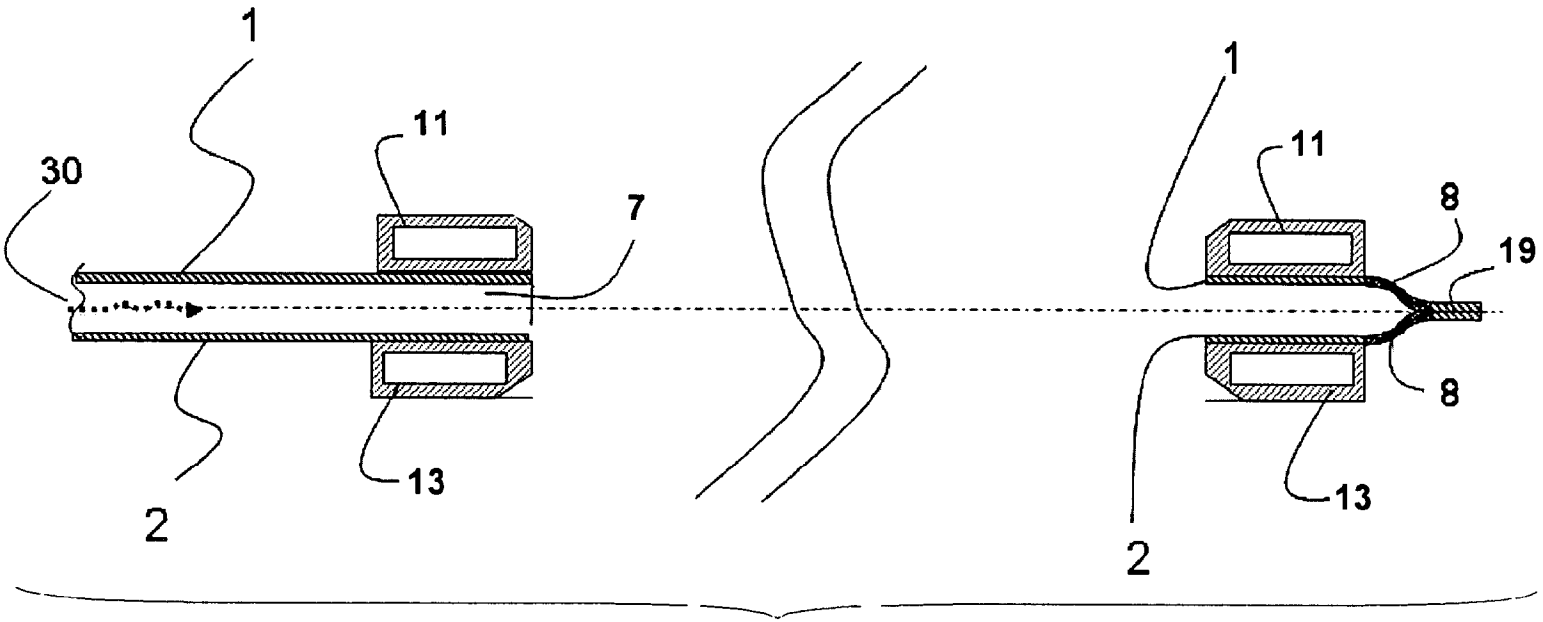
FIG. 10 is a side cross-sectional view of an alternative embodiment of an alternative embodiment having hollow manifold rings.

According to another embodiment, illustrated in FIG. 10, a heat exchange cell may be as described above, but where the reinforcing manifold rings 10, 11, 12, and 13 may be fabricated from a rolled section of rectangular cross-section tubing.

Figure 11A:
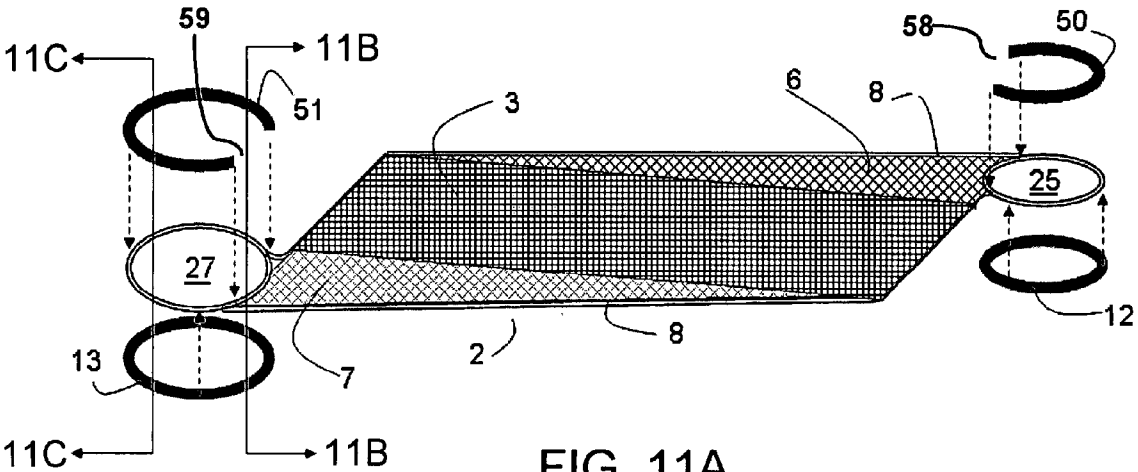
FIG. 11A is a partially exploded view with the upper plate removed for ease of exposition, illustrating an alternative embodiment wherein the elemental cell includes an additional reinforcing cut-ring captured within the cell envelope.
Figure 11B:
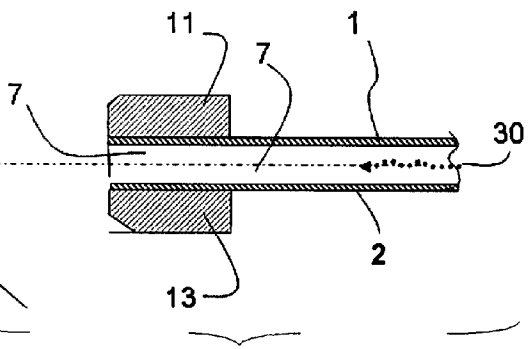
FIG. 11B is a side cross-sectional view taken along the lines 11B-11B in FIG. 11A.
Figure 11C:
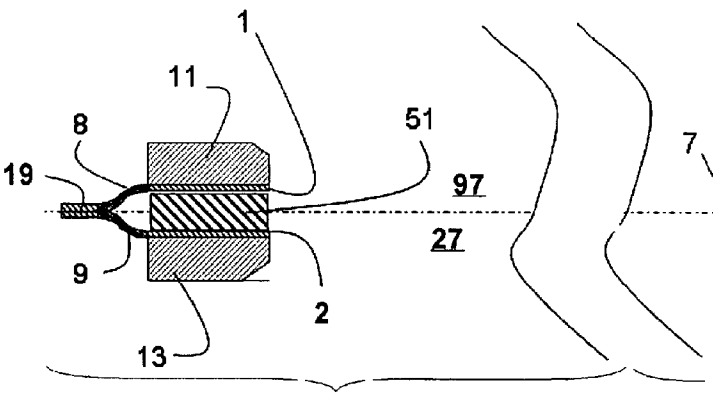
FIG. 11C is a side cross-sectional view taken along the lines 11C-11C in FIG. 11A.

According to yet another embodiment, illustrated in FIGS. 11A-11C, a heat exchange cell may be may be as otherwise described above in connection with the embodiments of FIG. 5 or 10, but wherein a cut-ring 51 is inserted into the dish-shaped form 8 surrounding the manifold cut-outs 97 and 27 of plates 1 and 2, respectively. The cut or open section 59 of cut-ring 51 is positioned at the opening of the header 7 to permit the unrestricted flow of the first fluid 30 out of the cell 20. Similarly, a cut-ring 50 is inserted into the envelope between the plates 1 and 2, surrounding the manifold cut-outs 15 and 25, with an open portion 58 of the ring oriented adjacent the header matrix 6 to permit the unrestricted flow of the first fluid 30 into the header 6 of the cell 20. The cut-rings 50 and 51 contact the corresponding aligned portions of the interior-facing surfaces of the plates 1 and 2, and are bonded thereto, for example by coating with a braze alloy and brazing. After the oven brazing process, the result is a further reinforcing of the brazed manifold stacks 22 and 23, thereby increasing their pressure capacity.

Figure 12A:
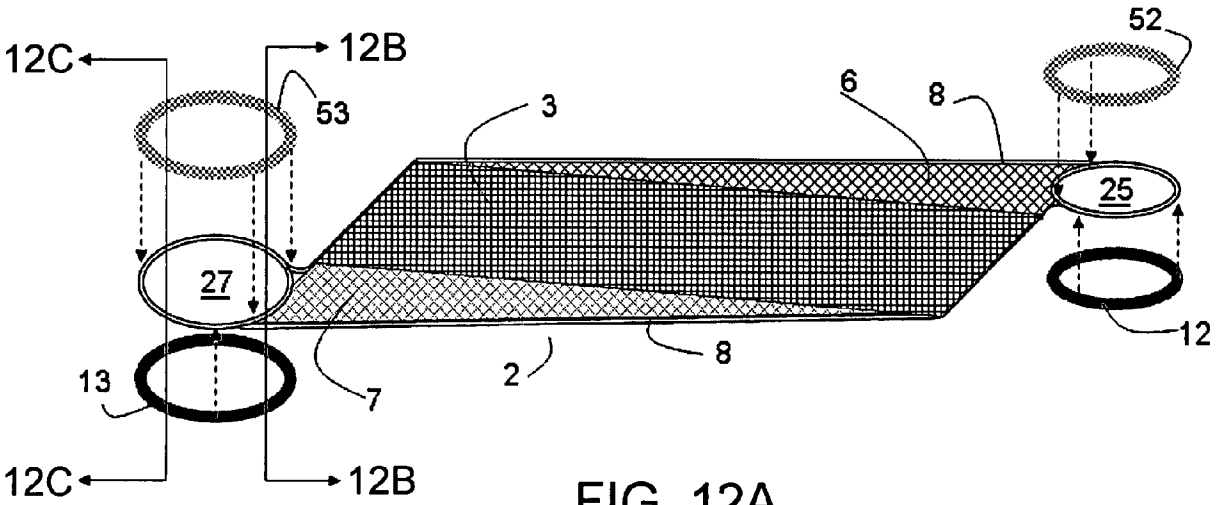
FIG. 12A illustrates an embodiment similar to the embodiment appearing in FIG. 11A, wherein is a porous reinforcing ring is captured within the cell envelope.
Figure 12B:
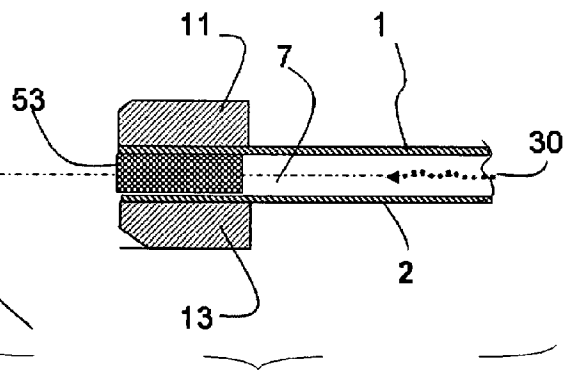
FIG. 12B is a side cross-sectional view taken along the lines 12B-12B in FIG. 12A.
Figure 12C:
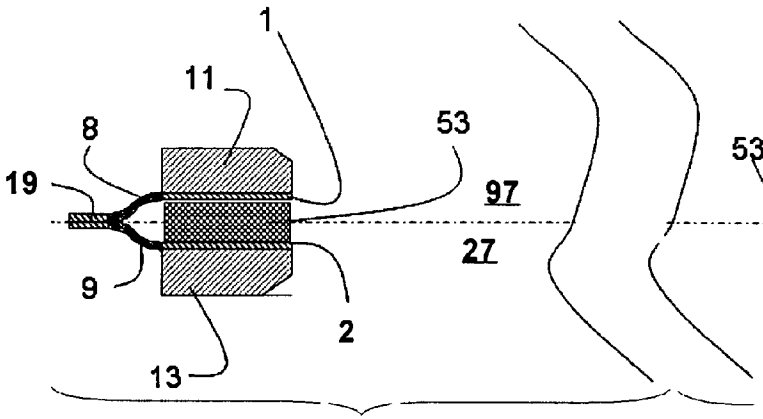
FIG. 12C is a side cross-sectional view taken along the lines 12C-12C in FIG. 12A.

According to still another embodiment, illustrated in FIGS. 12A-12C, porous rings 52 and 53 substitute for the cut-rings 50 and 51 appearing in FIGS. 11A-11C. The embodiment of FIGS. 12A-12C may otherwise be as described herein. In FIGS. 12A-12C, the porous ring 53 is inserted into the dish-shaped form 8 surrounding the manifold cutouts 97 and 27 of the plates 1 and 2. Similarly, the porous ring 52 is inserted into the envelope between the plates 1 and 2, surrounding the manifold cutouts 15 and 25. The porous rings 52 and 53 contact the corresponding aligned portions of the interior-facing surfaces of the plates 1 and 2, and are bonded thereto, for example by coating with a braze alloy and brazing. After the oven brazing process, the result is a further reinforcing of the brazed manifold stacks 22 and 23, thereby increasing their pressure capacity. The porous rings 52 and 53 need not have a cut out section; rather, the first fluid 30 permeates through the porous material of the rings 52, 53 with minimal resistance. The rings 52, 53 may be formed of any porous matrix or material that permits fluid to permeate through the rings to allow the fluid to pass from the inlet manifold to the cell interior volumes and from the cell interior volume to the outlet manifold.

The purpose of the porous-rings 52 and 53 are two-fold. First, the porous rings provide structural hoop strength to the manifold stacks 22 and 23. Second, when brazed to the surfaces of plates 1 and 2 at the intersection of the headers 6 and 7 with the manifold cutouts 15, 25 and 97, 27, the porous rings 52, 53 work in tension to resist a pressure force acting to separate plate 1 from plate 2.

Figure 13B:
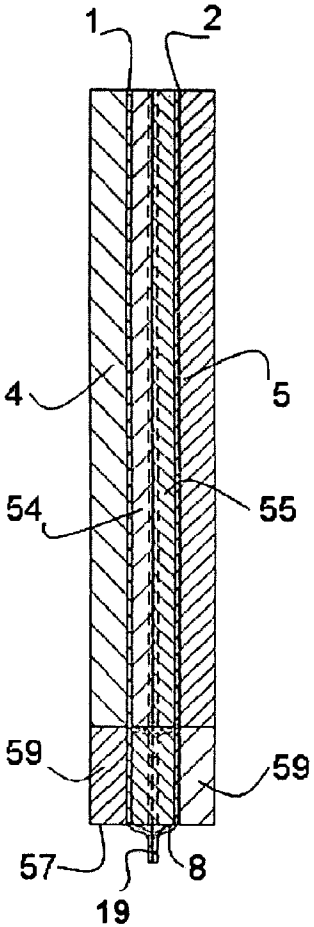
FIGS. 13A and 13B illustrate an alternative embodiment, tolerant to extreme pressures, where the matrix elements outside the cell envelope are compressively loaded upon one another.
Figure 13A:
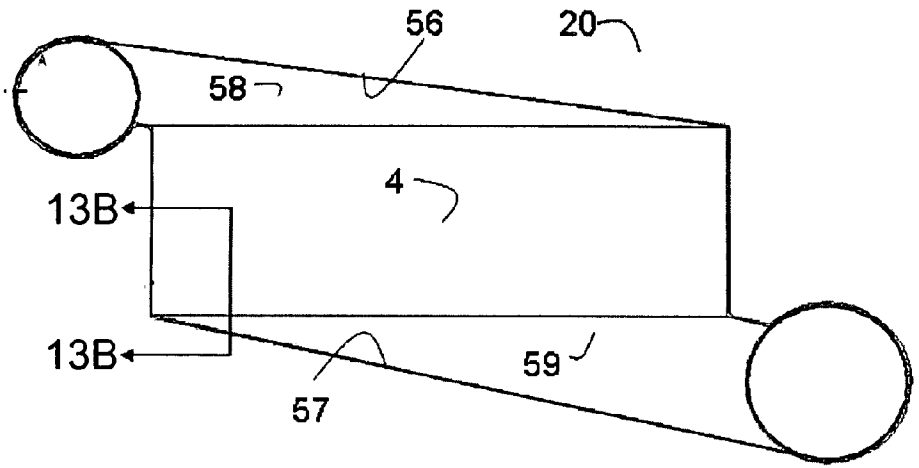

According to an alternative embodiment, shown in FIGS. 13A and 13B, the counter-flow matrix element 3 may be formed of two equal-thickness matrix elements 54 and 55. All other features of the heat exchanger design and assembly as described in the aforementioned description may be preserved with this embodiment.

A further enhancement of the FIGS. 13A and 13B embodiment extends the counter-flow matrix segments 4 and 5, affixed to the outer surfaces 61, 67 of the cell envelope 20, to the edges 56 and 57 of the plates 1 and 2. The purpose of this modification is to allow the matrix elements 54 and 55 to bear the compressive load that may occur as a result of pressurizing the interior 60 of the cell 20.

Figure 14A:
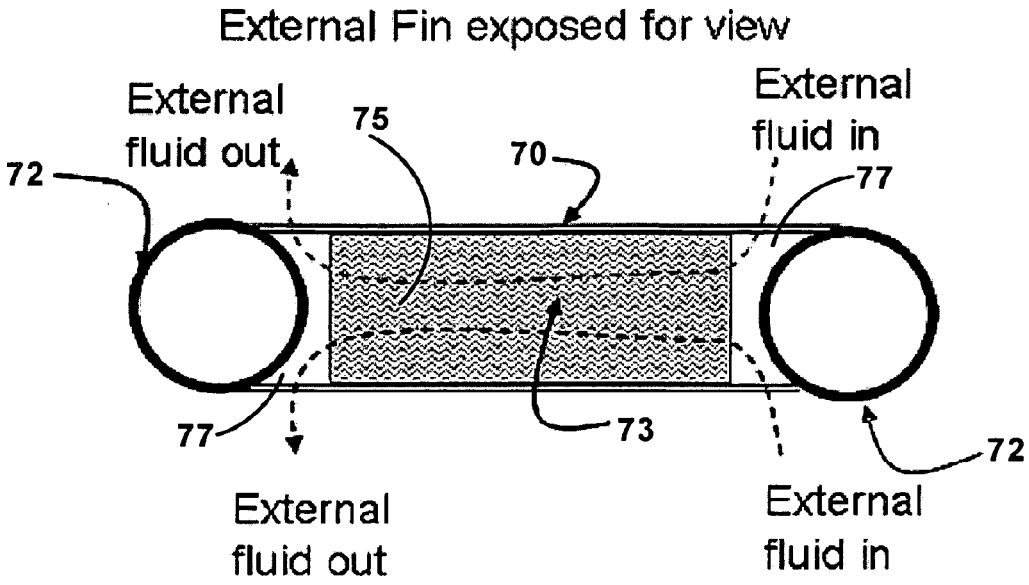
FIGS. 14A and 14B illustrate a "C-flow" embodiment of the heat exchange unit cell, which is composed of hoop rings, optional cut-rings, parting plates, and external and internal fin segments, similar to the embodiments appearing in FIGS. 5-13B.
Figure 14B:
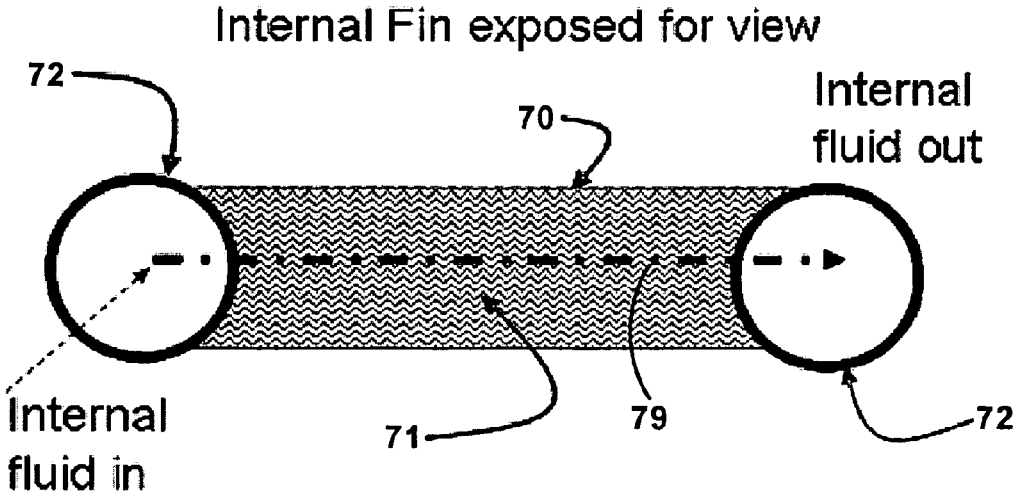

An variation of the Z-flow concept shown in FIGS. 5-13B is shown in FIGS. 14A and 14B. This design incorporates a so-called "C-flow" fluid arrangement. Rather than the "Z-flow" path taken by the internal cell fluid in FIGS. 5-13B, the arrangement described in FIGS. 14A and 14B has an internal flow path that is largely parallel to the side edges 70 of the core. This shortens the path of the internal fluid 79, permitting high-density fin 71 to extend between the two equal sized cutouts, forming the integral manifolds 72. The high-density fin 71 provides greater tensile strength and pressure capacity of the cell while the straight (non-Z-flow) path results in lower pressure drop. In the depicted preferred embodiment, as shown in FIG. 14B, the high surface area fin 71 extends all the way to the edge of the aperture defining the integral manifolds 72 and is cut to the radius or contour of the inner diameter of the manifolds 72 and the inner diameter of the reinforcing rings. Thus, the ends of the fin 71 extend between the reinforcing rings on opposite sides of the parting plates 1, 2 as the reinforcing rings.

The external fluid 73, needing no header fin, flows in a cross-counter flow manner, with a prevailing "C-flow" direction after entering and exiting the counterflow matrix. In certain embodiments of this arrangement, the external fluid 73 may enter and exit the header from both sides of the core, as shown. Alternatively, a flow arrangement wherein the external fluid 73 enters and exits the header from the same transverse side of the heat exchange core is also contemplated. The external fin arrangement shown in FIG. 14A includes open space 77 on the outer cell surface to provide space for the external fluid 73 to distribute across the frontal entrance and exit of the external heat exchange matrix 75. As shown in FIG. 14B, the internal fluid 79 flows parallel to the parting plate edges directly between the circular manifolds 72.

Figure 15A:
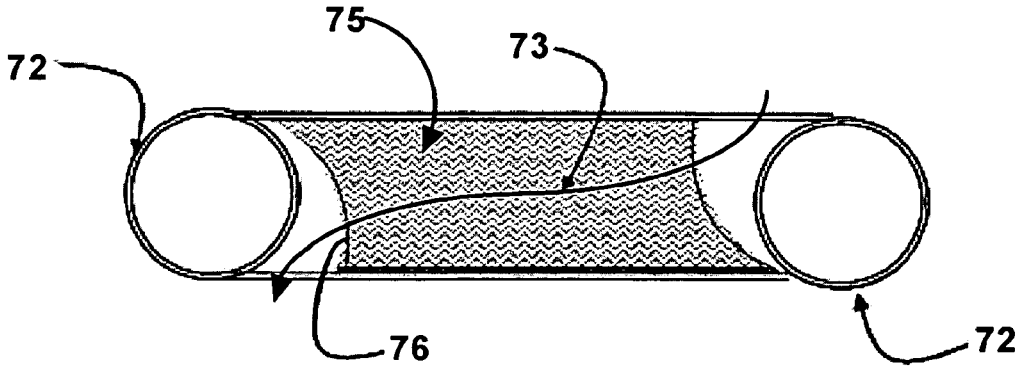
FIGS. 15A and 15B illustrate an alternative version of the C-flow unit cell embodiment appearing in FIGS. 14A and 14B.
Figure 15B:
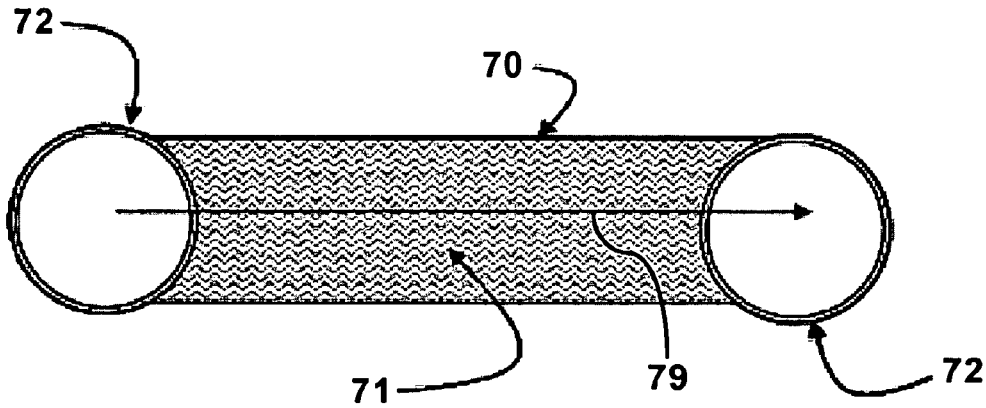

A variation on the embodiment shown in FIGS. 14A and 14B offers an alternative flow path for the external fluid 73 and associated header geometry. In FIGS. 15A and 15B, the external gas fin 75 is cut in a shape to provide a gas entrance region 76 to permit entrance and exit of the external fluid from one side of the heat exchange core only. This arrangement may have packaging advantages in some applications. The region 76 also provides space for the external fluid to distribute across the frontal entrance and exit of the external heat exchange matrix 75. As shown in FIG. 15B, the internal fluid flows parallel to the parting plate edges directly between the circular manifolds 72. As shown in FIG. 15A, the external fluid 73 is required to make a "Z-path", entering and exiting the heat exchange core on opposite transverse sides. As shown in FIG. 15B, the high surface area fin 71 extends all the way to the edge of the aperture defining the integral manifolds 72 and is cut to the radius or contour of the inner diameter of the manifolds 72 and the inner diameter of the reinforcing rings as described above by way of reference to FIG. 14B.

Figure 16:
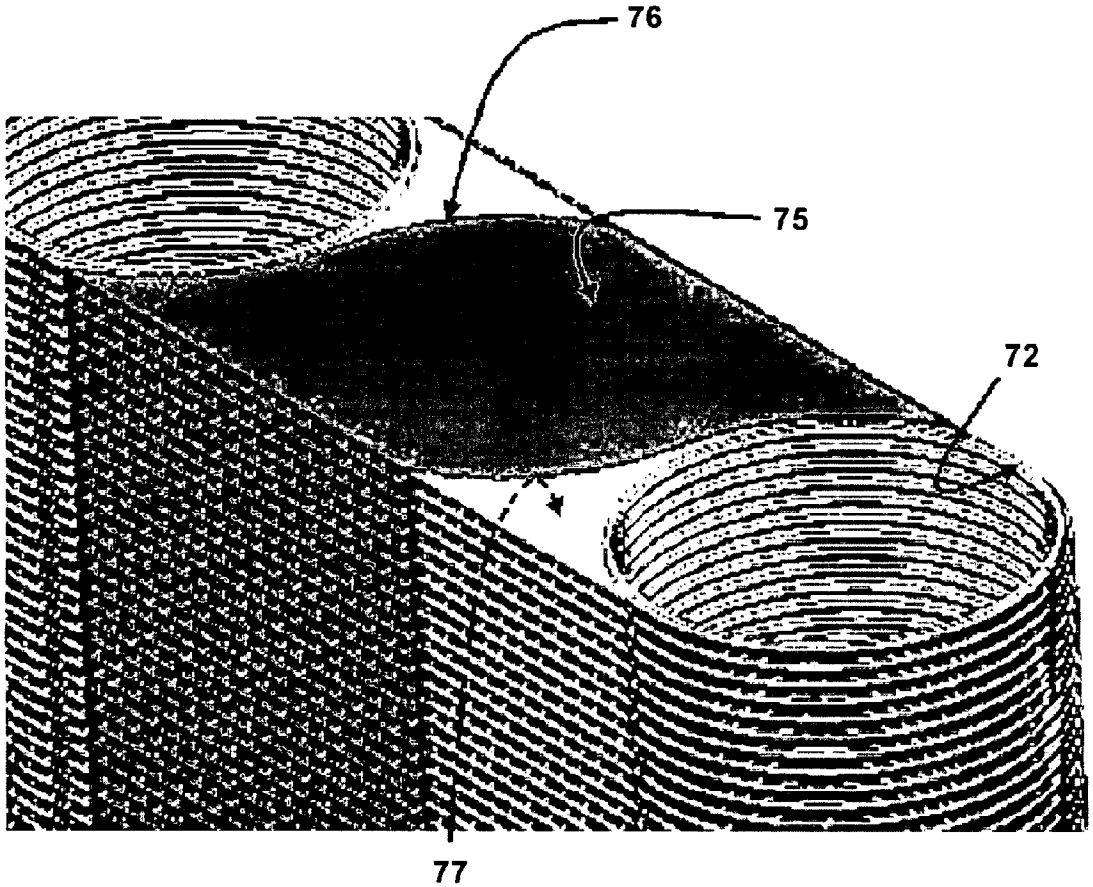
FIG. 16 is a fragmentary, isometric view of an alternative C-flow cell with an external gas fin configured to allow single side manifold for the external fluid.

FIG. 16 illustrates an isometric view of a multi-cell heat exchange core wherein the heat exchange cells include an external fin 75 with a curved edge 76 defining an entrance region 77 to enable entrance and exit of the heat exchange fluid on opposite transverse sides of the core.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

Having thus described the preferred embodiments, the invention is now claimed to be:

1. A heat exchange device for transferring heat between a first fluid and a second fluid, said heat exchange device comprising a plurality of heat exchange cells in a stacked arrangement, said heat exchange device defining an inlet manifold and an outlet manifold, each of said heat exchange cells comprising:

an upper cell plate having an exterior facing surface and an interior facing surface opposite the exterior facing surface;

said upper cell plate having an inlet aperture, an outlet aperture, a central upper cell plate portion extending between the inlet aperture and the outlet aperture, and an upper peripheral edge bounding said inlet aperture, outlet aperture, and said central upper cell plate portion;

a lower cell plate having an exterior facing surface and an interior facing surface opposite the exterior facing surface;

said lower cell plate having an inlet aperture, an outlet aperture, a central lower cell plate portion, and a lower peripheral edge bounding said inlet aperture, outlet aperture, and said central lower cell plate portion;

said lower cell plate juxtaposed with said upper cell plate so that the inlet aperture of the lower cell plate is aligned with the inlet aperture of the upper cell plate, the outlet aperture of the lower cell plate is aligned with the outlet aperture of the upper cell plate, and the central lower cell plate portion is aligned with the central upper cell plate portion;

the upper peripheral edge joined to the lower peripheral edge to define a cell peripheral edge;

the interior facing surface of the upper cell plate facing and spaced apart from the interior facing surface of the lower cell plate to define an interior volume therebetween;

said interior volume having a cell inlet and a cell outlet and defining a fluid passageway for the second fluid between the cell inlet and the cell outlet, wherein said cell inlet is adjacent the inlet aperture of the upper cell plate and the inlet aperture of the lower cell plate, and said cell outlet is adjacent the outlet aperture of the upper cell plate and the outlet aperture of the lower cell plate;

a first heat transfer matrix positioned within said interior volume, a second heat transfer matrix attached to the exterior surface of said upper cell plate, and a third heat transfer matrix attached to the exterior surface of the lower cell plate;

an upper inlet manifold ring bonded to the exterior surface of the upper plate and circumscribing the inlet aperture of said upper cell plate;

an upper outlet manifold ring bonded to the exterior surface of the upper plate and circumscribing the outlet aperture of said upper cell plate;

a lower inlet manifold ring bonded to the exterior surface of the lower plate and circumscribing the inlet aperture of said lower cell plate; and a lower outlet manifold ring bonded to the exterior surface of the lower plate and circumscribing the outlet aperture of said lower cell plate;

wherein the upper inlet manifold ring of one of said heat exchange cells is bonded to the lower inlet manifold ring of an adjacent one of said heat exchange cells and the upper outlet manifold ring of one of said heat exchange cells is bonded to the lower outlet manifold ring of an adjacent one of said heat exchange cells.

2. The heat exchange device of claim 1, further comprising:

said plurality of heat exchange cells including at least first and second heat exchange cells;

the upper inlet manifold ring of the first heat exchange cell attached to the lower inlet manifold ring of the second heat exchange cell via a first bond to define the inlet manifold; and the upper outlet manifold ring of the first heat exchange cell attached to the lower outlet manifold ring of the second heat exchange cell via a second bond to define the outlet manifold.

3. The heat exchange device of claim 2, wherein the first and second bonds are formed by welding, brazing, diffusion bonding, soldering, cementing, adhesive bonding, and sintering.

4. The heat exchange device of claim 1, further comprising:

said plurality of heat exchange cells including at least first, second, and third heat exchange cells;

the lower inlet manifold ring of the first heat exchange cell attached to the upper inlet manifold ring of the second heat exchange cell, and the lower inlet manifold ring of the second heat exchanger attached to the upper inlet manifold ring of the third heat exchange cell; and the lower outlet manifold ring of the first heat exchange cell attached to the upper outlet manifold ring of the second heat exchange cell, and the lower outlet manifold ring of the second heat exchanger attached to the upper outlet manifold ring of the third heat exchange cell.

5. The heat exchange device of claim 1, further comprising:

said second and third heat transfer matrices defining a flow passageway for the first fluid.

6. The heat exchange device of claim 5, wherein said heat exchange device is configured to transfer heat from the first fluid to the second fluid.

7. The heat exchange device of claim 1, further comprising:

said first heat transfer matrix having a first side bonded to the interior facing surface of the upper cell plate and a second side opposite the first side bonded to the interior facing surface of the lower cell plate.

8. The heat exchange device of claim 1, further comprising:

said second heat transfer matrix having a thickness which is equal to a thickness of said upper inlet manifold ring and a thickness of said upper outlet manifold ring; and said third heat transfer matrix having a thickness which is equal to a thickness of said lower inlet manifold ring and a thickness of said lower outlet manifold ring.

9. The heat exchange device of claim 1, further comprising:

the second and third heat transfer matrices of each heat exchange cell are not bonded to any other heat exchange cell of said plurality of heat exchange cells.

10. The heat exchange device of claim 1, further comprising:

each heat exchange cell having a first structural matrix for structurally enhancing the pressure containing potential of said heat exchange cell, the first structural matrix located within said interior volume, said first structural matrix having first, second, and third edges;

the first edge of the first structural matrix aligned with a first edge of the first heat transfer matrix;

the second edge of the first structural matrix intercepting one of said cell inlet and said cell outlet;

the third edge of the first structural matrix aligned with a portion of the peripheral edge of said upper cell plate and a portion of the peripheral edge of said lower cell plate.

11. The heat exchange device of claim 10, further comprising:

each heat exchange cell having a second structural matrix for structurally enhancing the pressure containing potential of said heat exchange cell, the second structural matrix located within said interior volume, said second structural matrix having first, second, and third edges;

the first edge of the second structural matrix aligned with a second edge of the first heat transfer matrix which is opposite the second edge of the first heat transfer matrix;

the second edge of the second structural matrix intercepting the other of said cell inlet and said cell outlet;

the third edge of the second structural matrix aligned with a portion of the peripheral edge of said upper cell plate and a portion of the peripheral edge of said lower cell plate.

12. The heat exchange device of claim 11, further comprising:

said first and second structural matrices are metallurgically bonded to the interior surface of the first plate and the interior surface of the second plate.

13. The heat exchange device of claim 1, further comprising:

said upper inlet manifold ring and said upper outlet manifold ring metallurgically bonded to the exterior surface of the upper plate;

said lower inlet manifold ring and said lower outlet manifold ring metallurgically bonded to the exterior surface of the lower plate.

14. The heat exchange device of claim 1, each heat exchange cell further comprising:

said upper peripheral edge being generally dish-shaped and defining an upper contact flange; and said lower peripheral edge being generally dish-shaped and defining a lower contact flange bonded to the upper contacting flange.

15. The heat exchange device of claim 1, each heat exchange cell further comprising:

a peripheral ring having an upper joining surface and a lower joining surface opposite the upper joining surface, the upper joining surface bonded to the upper peripheral edge and the lower joining surface bonded to the lower peripheral edge.

16. The heat exchange device of claim 1, wherein one or more of said upper inlet manifold ring, upper outlet manifold ring; lower inlet manifold ring; and, lower outlet manifold ring are formed of hollow rectangular tubing.

17. The heat exchange device of claim 1, each heat exchange cell further comprising:

one or both of a first reinforcing ring segment and a second reinforcing ring segment;

said first reinforcing ring segment disposed between the upper cell plate and the lower cell plate and partially circumscribing each of the upper inlet aperture and the lower inlet aperture, said first reinforcing ring segment having an opening aligned with said cell inlet to allow the second fluid to flow from the inlet manifold to the interior volume, the first reinforcing ring segment having an upper contact surface metallurgically bonded to the interior surface of the upper cell plate and a lower contact surface metallurgically bonded to the interior surface of the lower cell plate; and said second reinforcing ring segment disposed between the upper cell plate and the lower cell plate and partially circumscribing each of the upper outlet aperture and the lower outlet aperture, said second reinforcing ring segment having an opening aligned with said cell outlet to allow the second fluid to flow from the interior volume to the outlet manifold, the second reinforcing ring segment having an upper contact surface bonded to the interior surface of the upper cell plate and a lower contact surface bonded to the interior surface of the lower cell plate.

18. The heat exchange device of claim 1, each heat exchange cell further comprising:

one or both of a first annular reinforcing ring and a second annular reinforcing ring;

said first annular reinforcing ring disposed between the upper cell plate and the lower cell plate and circumscribing each of the upper inlet aperture and the lower inlet aperture, said first annular reinforcing ring formed of a porous material which, during operation, allows the second fluid to permeate through said first annular reinforcing ring from the inlet manifold to the interior volume, said first annular reinforcing ring having an upper contact surface metallurgically bonded to the interior surface of the upper cell plate and a lower contact surface metallurgically bonded to the interior surface of the lower cell plate; and said second annular reinforcing ring disposed between the upper cell plate and the lower cell plate and circumscribing each of the upper outlet aperture and the lower outlet aperture, said second annular reinforcing ring formed of a porous material which, during operation, allows the second fluid to permeate through said second annular reinforcing ring from interior volume to the outlet manifold, said second annular reinforcing ring having an upper contact surface bonded to the interior surface of the upper cell plate and a lower contact surface bonded to the interior surface of the lower cell plate.

19. The heat exchange device of claim 1, further comprising:

said first heat transfer matrix including an upper heat transfer matrix layer and a lower heat transfer matrix layer;

said upper heat transfer matrix layer having a first surface bonded to the interior facing surface of the upper cell plate and a second surface opposite the first surface;

said lower heat transfer matrix layer having a first surface bonded to the interior facing surface of the lower cell plate and a second surface opposite the first surface.

20. The heat exchange device of claim 19, further comprising:

the second surface of the upper heat transfer matrix layer and the second surface of the lower heat transfer matrix layer being in facing relation, wherein the second surface of the upper heat transfer matrix layer is not bonded to the second surface of the lower heat transfer matrix layer.

21. The heat exchange device of claim 1, further comprising:

said first heat transfer matrix having a first pair of opposing edges and a second pair of opposing edges, wherein said first pair of opposing edges are substantially parallel to a pair of opposing edges of the upper and lower cell plates; and one opposing edge of the second pair of opposing edges of the first heat transfer matrix being aligned with the cell inlet and having a shape which conforms to a shape of the inlet manifold at an intersection of the inlet manifold and the cell inlet; and the other opposing edge of the second pair of opposing edges of the first heat transfer matrix being aligned with the cell outlet and having a shape which conforms to a shape of the outlet manifold at an intersection of the outlet manifold and the cell outlet.

22. The heat exchange device of claim 21, wherein each of the second pair of opposing edges of the first heat transfer matrix has a transverse dimension which is equal to or slightly larger than a diameter of said inlet and outlet manifolds, thereby allowing the second fluid to flow directly from the cell inlet to the cell outlet.

23. The heat exchange device of claim 1, wherein each of the upper cell plate inlet aperture, the upper cell plate outlet aperture, the lower cell plate inlet aperture, the lower cell plate outlet aperture, the upper inlet manifold ring, the upper outlet manifold ring the lower inlet manifold ring and the lower outlet manifold ring have a shape selected from circular and D-shaped.

24. The heat exchange device of claim 1, wherein:

said first heat transfer matrix is elongate and has a longitudinal axis;

said inlet and outlet manifolds are axially spaced apart from each other along said longitudinal axis; and each of said inlet and outlet manifolds are aligned with said longitudinal axis.

25. The heat exchange device of claim 1, wherein:

said first heat transfer matrix is elongate and has a longitudinal axis;

said inlet and outlet manifolds are axially spaced apart from each other along said longitudinal axis; and said inlet and outlet manifolds are transversely displaced from the longitudinal axis and are positioned on opposite transverse sides of said longitudinal axis.

26. A method of manufacturing a heat exchange device of a type for transferring heat between a first fluid and a second fluid, said method comprising:

assembling a plurality of heat exchange cells, each heat exchange cell including:

an upper cell plate having an exterior facing surface and an interior facing surface opposite the exterior facing surface;

said upper cell plate having an inlet aperture, an outlet aperture, a central upper cell plate portion extending between the inlet aperture and the outlet aperture, and an upper peripheral edge bounding said inlet aperture, outlet aperture, and said central upper cell plate portion;

a lower cell plate having an exterior facing surface and an interior facing surface opposite the exterior facing surface;

said lower cell plate having an inlet aperture, an outlet aperture, a central lower cell plate portion, and a peripheral edge bounding said inlet aperture, outlet aperture, and said central lower cell plate portion;

said lower cell plate juxtaposed with said upper cell plate so that the inlet aperture of the lower cell plate is aligned with the inlet aperture of the upper cell plate, the outlet aperture of the lower cell plate is aligned with the outlet aperture of the upper cell plate, and the central lower cell plate portion is aligned with the central upper cell plate portion;

the upper peripheral edge joined to the lower peripheral edge to define a cell peripheral edge;

the interior facing surface of the upper cell plate facing and spaced apart from the interior facing surface of the lower cell plate to define an interior volume therebetween;

said interior volume having a cell inlet and a cell outlet and defining a fluid passageway for the second fluid between the cell inlet and the cell outlet, wherein said cell inlet is adjacent the inlet aperture of the upper cell plate and the inlet aperture of the lower cell plate, and said cell outlet is adjacent the outlet aperture of the upper cell plate and the outlet aperture of the lower cell plate;

a first heat transfer matrix positioned within said interior volume, a second heat transfer matrix attached to the exterior surface of said upper cell plate, and a third heat transfer matrix attached to the exterior surface of the lower cell plate;

an upper inlet manifold ring bonded to the exterior surface of the upper plate and circumscribing the inlet aperture of said upper cell plate;

an upper outlet manifold ring bonded to the exterior surface of the upper plate and circumscribing the outlet aperture of said upper cell plate;

a lower inlet manifold ring bonded to the exterior surface of the lower plate and circumscribing the inlet aperture of said lower cell plate; and a lower outlet manifold ring bonded to the exterior surface of the lower plate and circumscribing the outlet aperture of said lower cell plate;

stacking said plurality of heat exchange cells such that a contacting surface of the lower inlet manifold ring of one of said plurality of said heat exchange cells contacts a contacting surface of the upper inlet manifold ring of an adjacent one of said plurality of heat exchange cells and a contacting surface of the lower outlet manifold ring of said one of said plurality of said heat exchange cells contacts a contacting surface of the upper outlet manifold ring of said adjacent one of said plurality of heat exchange cells; and metallurgically joining the plurality of heat exchange cells at the contacting surfaces of the upper and lower inlet manifold rings and the contacting surfaces of the upper and lower outlet manifold rings.

* * * * *